United States Patent [19]

Halicho

[11] 4,379,643

[45] Apr. 12, 1983

[54] TIMEPIECE CASE/BACKCOVER ASSEMBLY

[75] Inventor: James J. Halicho, Sunnyvale, Calif.

[73] Assignee: Timex Corporation, Waterbury, Conn.

[21] Appl. No.: 286,423

[22] Filed: Jul. 24, 1981

[51] Int. Cl.[3] ..... G04B 37/00; G04B 29/00

[52] U.S. Cl. ..... 368/309; 368/292

[58] Field of Search ..... 368/276, 286, 281, 309, 368/291, 292, 287

[56] References Cited

U.S. PATENT DOCUMENTS 2,350,651 6/1944 Taubert et al. ..... 368/276

4,241,442 12/1980 Grohoski ..... 368/276

FOREIGN PATENT DOCUMENTS 1239947 6/1960 France ..... 368/286

*Primary Examiner*—Bernard Roskoski

*Attorney, Agent, or Firm*—William C. Crutcher

[57] ABSTRACT

Disclosed is a timepiece construction in which the case and back cover member typically have snap-fit engagement surfaces with a polygonal plan profile composed of a plurality of circular arc surface portions having a common center point and a plurality of rectilinear surface portions connecting the circular arc surface portions together. Snap-fit engagement between the surfaces is effected only at the circular arc surface portions.

A sealing gasket may be interposed and compressed between a case flange and inside surface of the back cover member.

14 Claims, 21 Drawing Figures

TIMEPIECE CASE/BACKCOVER ASSEMBLY

FIELD OF THE INVENTION

The present invention relates to a timepiece construction and, in particular, to snap-fit engagement means for attaching of a back cover member to a timepiece case.

BACKGROUND OF THE INVENTION

U.S. Pat. No. 4,188,778 issued Feb. 19, 1980 to P. Wuthrich discloses a timepiece comprising a case with a circular engagement surface on a back side defining a rear access opening in the case and a back cover member having a peripheral engagement surface of noncircular, multilobed profile adapted to snap-fit to the circular case engagement surface. As a result of its multilobed nature, the back cover member is in snap-fit relation to the circular case engagement surface at only multiple spaced locations corresponding in number to the number of lobes. This type of engagement facilitates removal of the back cover member from the case.

Noncircular caseback configurations are also disclosed in the Miyashita U.S. Pat. No. 3,696,608 issued Oct. 10, 1972 and the Miyasaka U.S. Pat. No. 3,940,922 issued Mar. 2, 1976.

Recent trends in the styling of wristwatches, especially digital wristwatches, have shown a preference for shaped or non-circular cases of generally smaller dimensions. Unfortunately, this trend has limited the amount of space available for a rear access opening and engagement surface on the back side of the watchcase. The size of circular access openings and engagement surfaces has been particularly restricted. Prior art workers have in some situations opted to use shaped access openings and engagement surfaces but these are disadvantageous from the standpoint of increasing manufacturing and machining costs of the case and back cover member. What is needed is an engagement system for the case and back cover member which can be accommodated on smaller, shaped cases and which can be manufactured with conventional equipment and machining procedures.

SUMMARY OF THE INVENTION

Briefly stated, the present invention contemplates a timepiece construction in which the case and back cover member include snap-fit engagement surfaces having a polygonal plan profile composed of a plurality of circular arc surface portions having a common center point and having a plurality of noncircular surface portions connecting the circular arc surface portions together. Preferably, the circular arc surface portions are diametrically opposed and the noncircular surface portions are rectilinear. Snap-fit engagement between the surfaces is effected at the circular arc surface portions only.

The polygonal plan profile employed in the invention is particularly advantageous since it can be readily accommodated on smaller, shaped timepiece cases and since machining may be limited to the circular arc surface portions and may be conducted on conventional equipment for radial machining.

In a particular preferred embodiment of the invention, gasket means preferably having the polygonal plan profile described above is interposed and compressed between the case, particularly a rearwardly extending flange on the case also having such a profile, and the inside back portion of the back cover member. The back cover member in this embodiment preferably includes a frontwardly extending rim having the above described polygonal plan profile to snap-fit onto the flange of the case.

DESCRIPTION OF PREFERRED EMBODIMENTS

Figure 1:
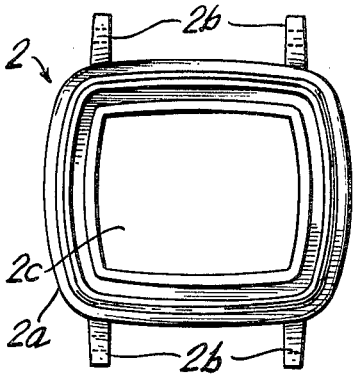
FIG. 1 is a front plan view of a watchcase.
Figure 2:
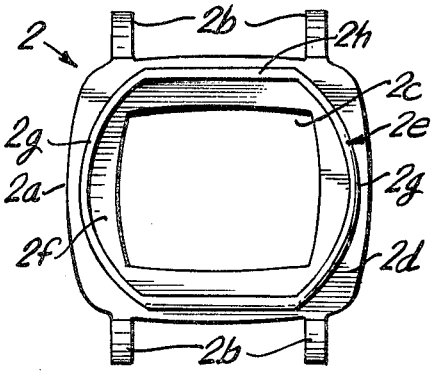
FIG. 2 is a rear plan view of the watchcase.

FIGS. 1 and 2 show a watch case 2 comprising a diecast case band **2*a* having a pair of spaced apart lugs 2*b* on opposite sides. Of course, a watch band, strap or bracelet is attached to the lugs by means of a conventional spring bar connector (not shown) having spring-urged pintles which are inserted in holes in the lugs. The case band includes a central window 2*c*** in the front side to allow viewing of a time display (not shown) housed therein. Of course, the time display may be provided in the form of an electrooptical display, an analog display having rotating hour and minute hands or hybrids thereof, all of which are well known to those skilled in the art and the particular construction of which form no part of the present invention.

Figure 3:
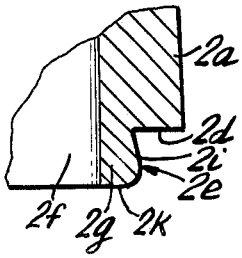
FIG. 3 is a partial cross-section through a circular arc surface portion of the case flange.

The rear side of case 2 is shown in FIGS. 2 and 3 as comprising a rear peripheral surface **2*d*, generally flat, and a rearwardly extending flange 2*e* defining a rear access opening 2*f*** in the case band. As shown, the flange 2e is characterized by a four-sided polygonal plan profile composed of diametrically opposed first circular arc surface portions 2g having a common center point and parallel rectilinear surface portions 2h connecting the circular arc portions together. In simple form, this polygonal plan profile may be viewed as a truncated circle. For purposes of providing a snap-fitting engagement surface on the flange, the exterior peripheral engagement surface 2i of each circular arc portion is radially machined to provide a 10° undercut surface as shown most clearly in FIG. 3. By using the case flange with the polygonal plan profile, the circular arc portion 2g can be easily and inexpensively radially machined with conventional equipment. This is an important advantage of the present timepiece construction. The rectilinear surface portions 2h need not be subjected to any machining operations. Rectilinear surface portions 2h as well as portions 2g have tapered as-cast "draw" surfaces (FIG. 4) to aid in removal of the case band from the diecasting machine. Of course, if the case band is not die cast or molded, the surface portions 2h and 2g may initially be straight or nontapered. As will be explained hereinbelow, snap-fitting engagement between the back cover member 3 and case band 2 is effected only at the circular arc portions 2g.

Figure 4:
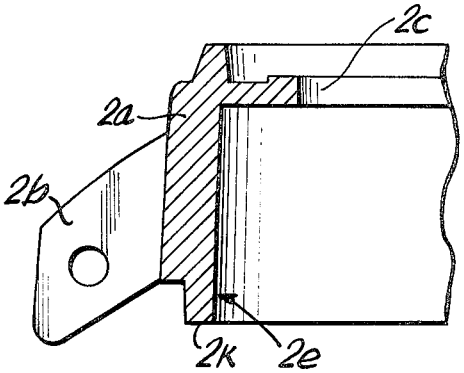
FIG. 4 is a partial cross-section through a rectilinear surface portion of the case flange.
Figure 9:
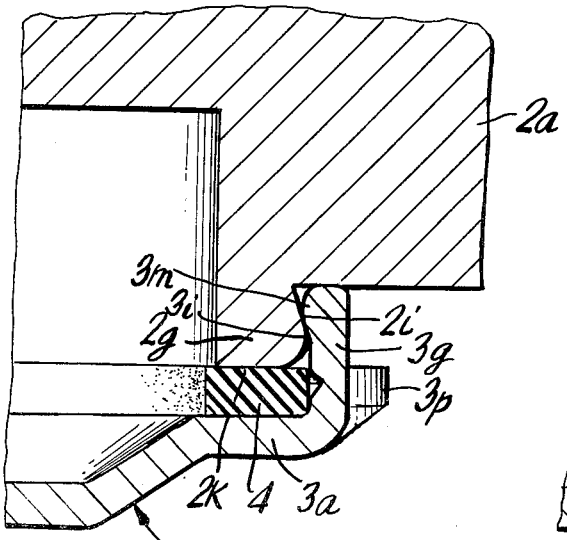
FIG. 9 is a partial cross-section showing the back cover member snap-fitted to the case at circular arc portions.
Figure 10:
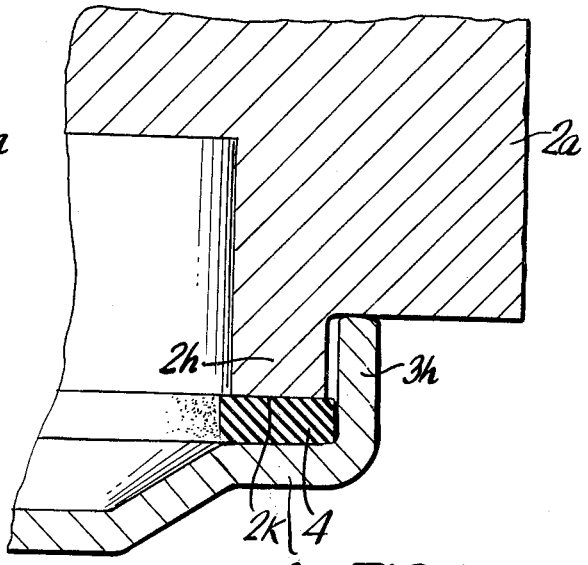
FIG. 10 is a partial cross-section showing the back cover member and case at rectilinear surface portions.

As shown in FIGS. 3 and 4, the case flange 2e terminates in a sealing surface 2k which contacts the sealing gasket 4 as shown in FIGS. 9 and 10.

Figure 6:
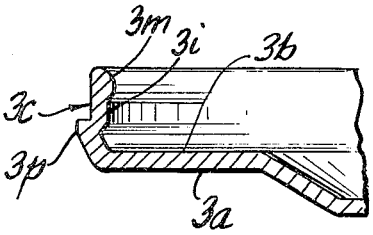
FIG. 6 is a partial cross-section through a circular arc surface portion of the back cover rim.
Figure 5:
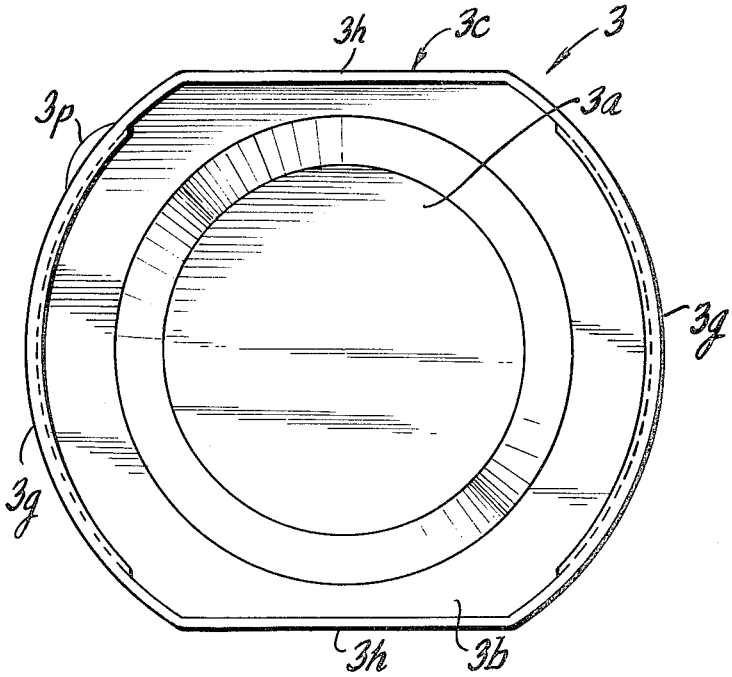
FIG. 5 is a front plan view of the back cover member.
Figure 7:
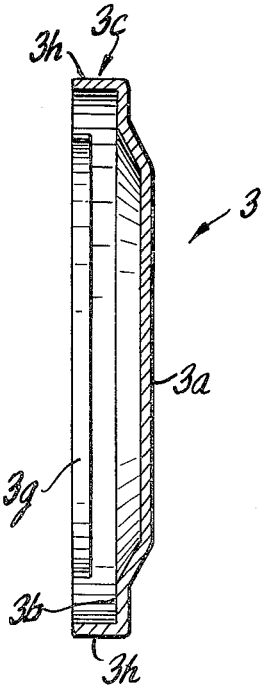
FIG. 7 is a cross-section through the back cover member showing the rectilinear surface portions of the rim.

The back cover member 3 adapted for use with watch case 2 is shown in FIGS. 5, 6 and 7. The stamped sheet metal back cover member includes a back portion 3a having an inner back surface 3b which faces the watch case when the components are engaged. Extending frontwardly from the back portion is rim 3c which is characterized also by a polygonal plan profile composed of diametrically opposed second circular arc surface portions 3g connected together by a pair of parallel rectilinear surface portions 3h. The circular arc portions are stamped to provide an inner peripheral engagement surface 3i adapted to snap-fit against the exterior engagement surface 2i of case flange 2e. In particular, the engagement surface 3i includes an inwardly extending boss 3m which snaps onto the undercut engagement surface 2i as shown in FIG. 9. FIG. 7 illustrates that the rectilinear surface portions 3h extend frontwardly with generally no taper. The rectilinear surface portions 3h of the rim are in spaced-apart, non-snap-fit relation with the rectilinear surface portions 2h on the case flange as shown in FIG. 10. It is apparent that there is no snap-fitting engagement between the rectilinear surface portions of the case flange and back cover rim.

Back cover member 3 is provided with a projecting lip 3p, FIGS. 5 and 9, to facilitate unsnapping of the cover member from the case 2.

Figure 8:
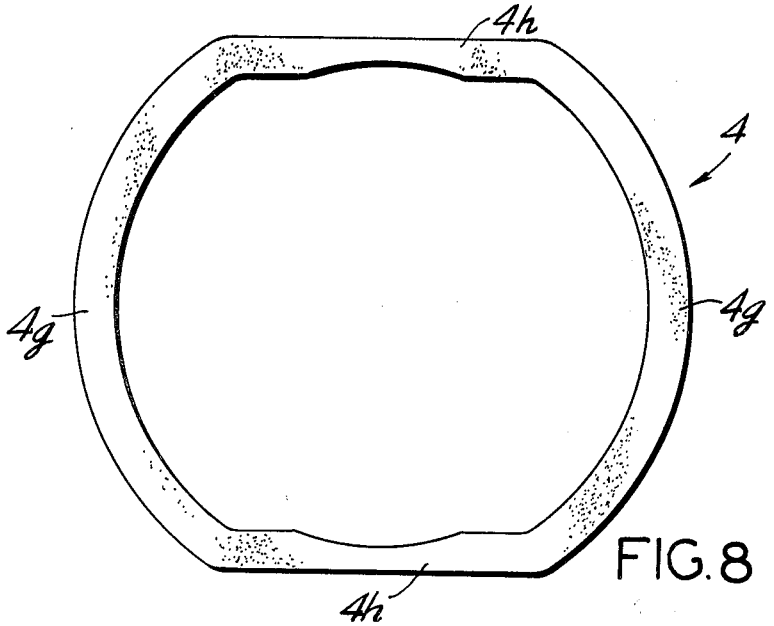
FIG. 8 is a plan view of the sealing gasket.

As shown in FIGS. 9 and 10, a sealing gasket 4 is interposed and compressed between the sealing surface 2k of the case flange and the inner back surface 3b of the back cover member to provide resistance to water penetration. The gasket is typically positioned on the inner back surface of the back cover and then the back cover is snap-fitted onto the case flange as described hereinabove. This action compresses the gasket sufficiently to provide a water resistant joint between the case and back cover member. As shown in FIG. 8, the gasket also preferably has a polygonal plan profile at least on the exterior side composed of diametrically opposed circular arc portions 4g and rectilinear surface portions 4h connecting therebetween. Typically, the sealing gasket is made of well known natural or synthetic rubbers or elastomers made for this purpose. The gasket may have generally flat surfaces for contacting the sealing surface 2k and inner back surface 3b or other cross-sectional configurations, e.g. the gasket surface in contact with sealing surface 2k may have a protruding portion such as a rounded hump or triangular profile extending toward the sealing surface to enhance sealing action therewith.

Figure 11:
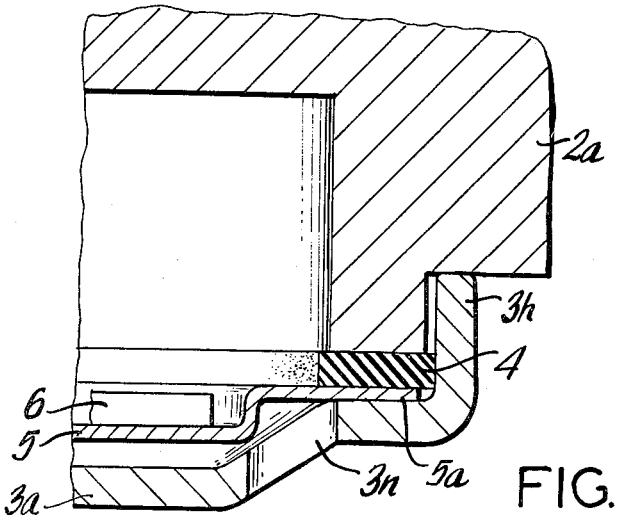
FIG. 11 is similar to FIG. 10 but also including a diaphragm plate sandwiched between the gasket and back cover member for purposes of alarm sound generation.

FIG. 11 is similar to FIG. 10 with the addition that a diaphragm plate 5 carrying a vibrating element 6 such as a piezoelectric element is incorporated into the timepiece. In particular, the diaphragm plate has a annular lip 5a interposed between the gasket 4 and inside back surface of the back cover member. The back cover member includes one or more holes 3n to provide for alarm sound emission from the timepiece. For example, as is well known in the art, the plate 5 is caused to vibrate by imposition of an electric signal upon element 6 thereby producing an alarm sound at a preselected time, and the sound is emitted through holes 3n.

Figure 12:
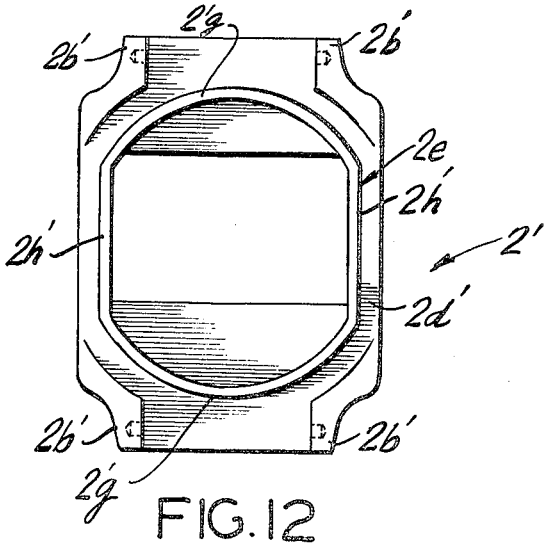
FIG. 12 is a rear plan view of another watchcase.
Figure 13:
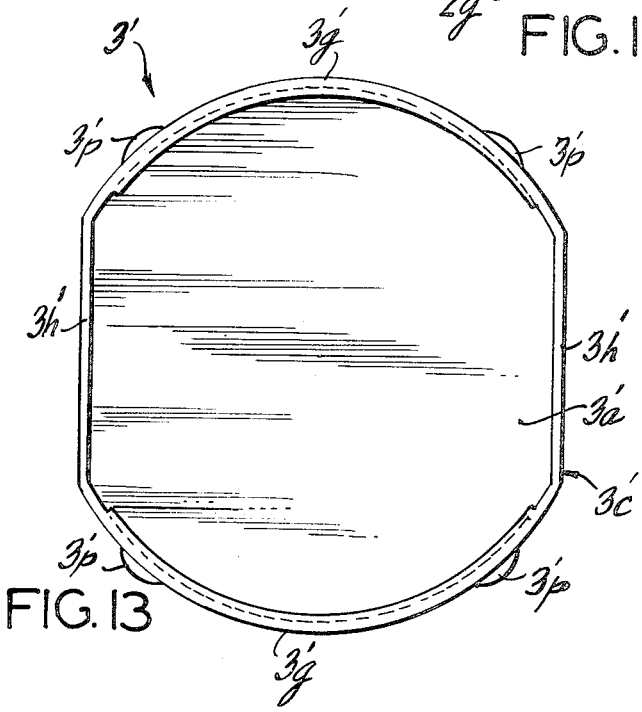
FIG. 13 is a front plan view of a back cover member for use with the case of FIG. 12.
Figure 15:
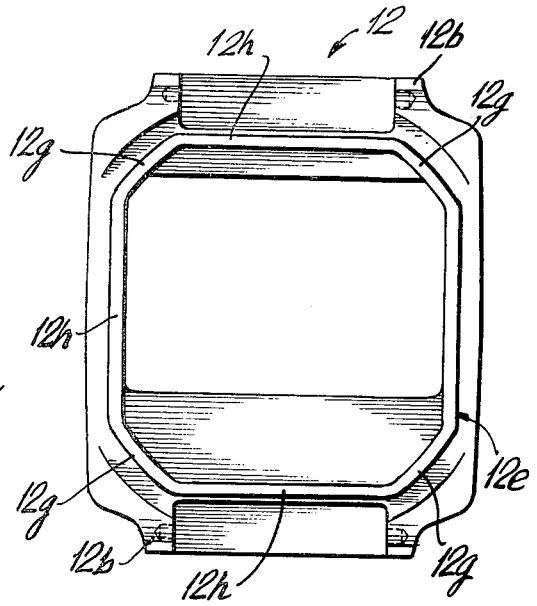
FIG. 15 is a plan view of still another watchcase.
Figure 14:
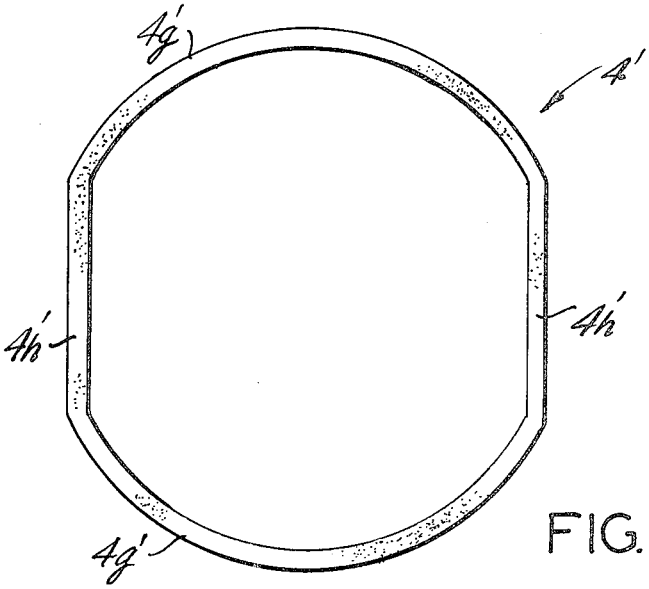
FIG. 14 is a plan view of a gasket for use with the case and back cover member of FIGS. 12 and 13.
Figure 16:
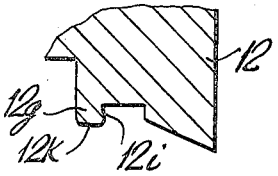
FIG. 16 is a partial cross-section through a circular arc portion of the case flange of FIG. 15.
Figure 17:
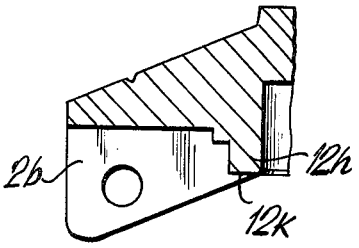
FIG. 17 is a partial cross-section through a rectilinear surface portion of the case flange of FIG. 15.
Figure 18:
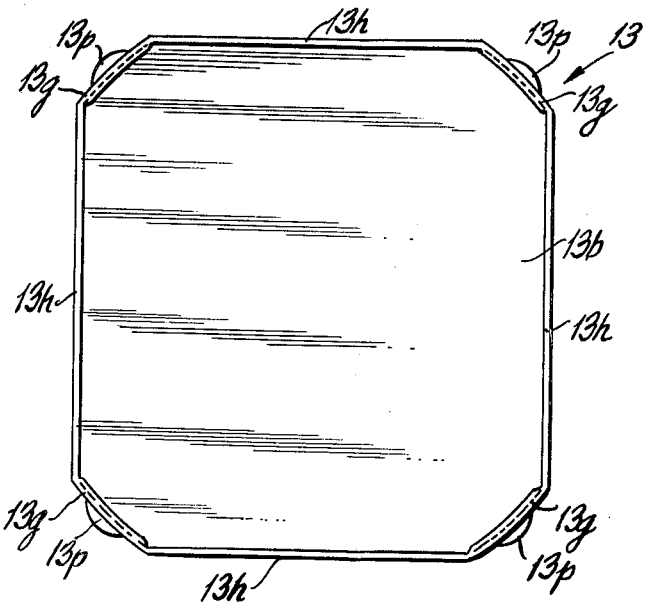
FIG. 18 is a front plan view of a back cover member for use with the case of FIG. 15.
Figure 19:
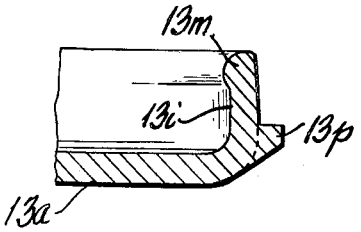
FIG. 19 is a partial cross-section through a circular arc portion of the rim of the back cover member.
Figure 20:
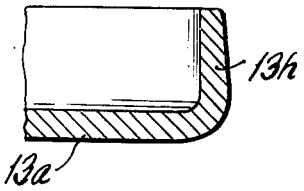
FIG. 20 is a partial cross-section through a rectilinear surface portion of the back cover member.

FIGS. 12–14 illustrate another embodiment of the invention employing a watchcase $2^1$, back cover member $3^1$ and sealing gasket $4^1$ having surfaces with a four-sided polygonal plan profile. One difference between this embodiment and that described hereinabove is in the orientation of the sides of the polygon relative to the lugs. In FIGS. 12–14, the rectilinear sides of the polygon extend in the direction of lug extension whereas in the embodiment described above the rectilinear sides 2h extend transverse to the lug extension direction. Generally, the watchcase and back cover member of FIGS. 12–14 include similar features as those described in the above embodiment and like features are represented by like numerals primed.

In another modification of the invention, a watchase 12 and back cover member 13 with eight-sided snap-fit engagement surfaces are used as depicted in FIGS. 15–20. As shown, the case includes a rearwardly extending flange 12e having a polygonal plan profile composed of four circular arc portions 12g with a common center point and four rectilinear portions 12h. It is apparent that there are two pairs of circular arc portions in diametrically opposed relation. An exterior engagement surface 12i is provided by radially machining a 15° or other angular undercut in the exterior of the circular arc portions 12g, FIG. 16, while the rectilinear portions 12h have generally straight as-cast exterior surfaces, FIG. 17.

The back cover member 13 includes a flat back portion 13b having similar circular arc portions 13g and rectilinear portions 13h as the case flange 12e, although slightly larger in diameter and width. The circular arc portions 13g are adapted to snap-fit onto the exterior of circular arc portions 12g of the case flange as already described hereinabove with respect to FIGS. 9 and 10. To this end, the circular arc portions 13g have an inner engagement surface 13i with an inwardly projecting boss 13m, FIG. 19, to snap onto the undercut of the case engagement surface. The rectilinear portions 13h have generally straight inner surfaces and slightly tapered (5°) exterior surfaces, FIG. 20. A lip 13p is stamped into each circular arc portion to facilitate unsnapping of the back cover member.

Figure 21:
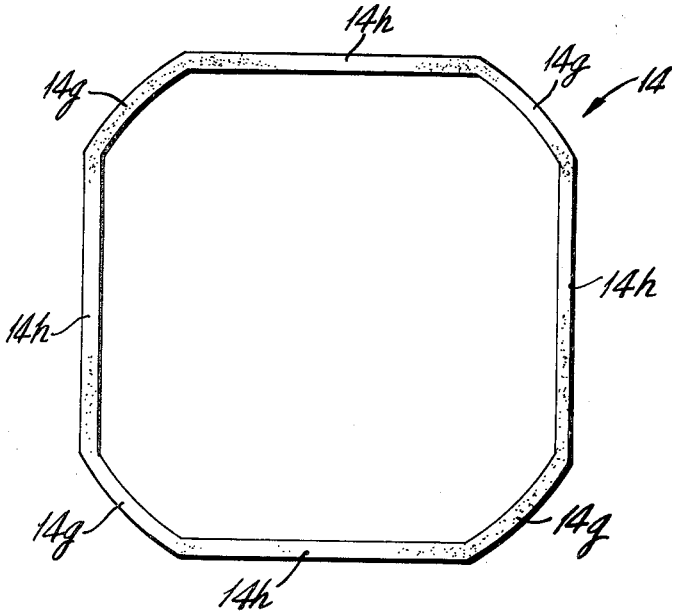
FIG. 21 is a plan view of the gasket for use with the case and back cover member of FIGS. 15 and 18.

A sealing gasket 14 for use with the watch case and back cover member of FIGS. 15–20 is shown in FIG. 21. It is apparent that the gasket is given the eight-sided polygonal plan profile including circular arc portions 14g and rectilinear portions 14h. The gasket is interposed and compressed between the sealing surface 12k of the case flange and the inside back surface 13b when the case and back cover member are snap-fitted together as described above.

Although the engagement surfaces described hereinabove have been illustrated as having a polygonal plan profile with an even number of sides, it is apparent that polygons with odd-numbered sides may also be employed in the invention. Although the polygons are specifically shown hereinabove as composed of circular arc surface portions connected together by rectilinear connecting surface portions, it is apparent that curvilinear surface portions as well as rectilinear portions may also be employed as connecting surfaces. Regardless of the connecting surface employed, it is preferred that the connecting surfaces do not extend outside the circumference of the full circle of which the circular arc portions are a part. And, it is apparent that case manufacturing techniques other than diecasting, e.g. stamping, machining or plastic injection molding may also be employed. The case of course may be made of metal, plastic or of other materials or composites thereof. The back cover member likewise may be machined, plastic injection molded as well as stamped of metal, plastic or composites.

And, while the invention has been explained by a detailed description of certain specific embodiments, it is understood that various modifications and changes can be made in any of them within the scope of the appended claims which are intended also to include such modified embodiments.

I claim:

1. In a timepiece construction, the combination of:

(a) a case having a first engagement surface with a polygonal plan profile composed of a plurality of first circular arc surface portions having a common center point and a plurality of first noncircular surface portions connecting the first circular arc surface portions together, and (b) a back cover member having a second engagement surface with a polygonal plan profile composed of a plurality of second circular arc surface portions having a common center point and a plurality of second noncircular surface portions connecting the second circular arc surface portions together, the second circular arc surface portions being adapted for snap-fitting against the respective first circular arc surface portions to hold the back cover member and case releasably together.

2. The combination of claim 1 wherein the first noncircular surface portions and second noncircular surface portions are rectilinear.

3. The combination of claim 1 wherein gasket means is interposed between the case and back cover member.

4. In a timepiece construction, the combination of:

(a) a case having a first engagement surface with a polygonal plan profile composed of a plurality of diametrically opposed first circular arc surface portions connected together by a plurality of first noncircular surface portions, and (b) a back cover member having a second engagement surface with a polygonal plan profile composed of a plurality of diametrically opposed second circular arc surface portions connected together by a plurality of second noncircular surface portions, the second circular arc surface portions being adapted for snap-fitting against the respective first circular arc surface portions to hold the back cover member releasably to the case.

5. In a timepiece construction, the combination of:

(a) a case having a first engagement surface with a polygonal plan profile composed of a plurality of diametrically opposed first circular arc surface portions connected together by a plurality of opposed first rectilinear surface portions, and (b) a back cover member having a second engagement surface with a polygonal plan profile composed of a plurality of diametrically opposed second circular arc surface portions connected together by a plurality of opposed second rectilinear surface portions, the second circular arc surface portions being adapted for snap-fitting against the first circular arc surface portions to hold the back cover member releasably to the case.

6. The combination of claim 5 wherein the first engagement surface is composed of two diametrically opposed first circular arc surface portions connected together by two parallel first rectilinear surface portions, and wherein the second engagement surface is composed of two diametrically opposed second circular arc surface portions connected by two parallel second rectilinear surface portions.

7. The combination of claim 5 wherein the first engagement surface has an eight-sided polygonal plan profile composed of four first circular arc surface portions spaced 90° apart such that two pairs are diametrically opposed and four first rectilinear surface portions connecting the first circular arc portions together, and wherein the second engagement surface has a eight-sided polygonal plan profile composed of four second circular arc surface portions spaced 90° apart such that two pairs arc diametrically opposed and four second rectilinear surface portions connecting the second circular arc surface portions together.

8. In a timepeice construction, the combination of:

(a) a case having a first engagement surface with a polygonal plan profile composed of a plurality of first circular arc surface portions having a common center point and a plurality of first rectilinear surface portions connecting the first circular arc surface portions together, and (b) a back cover member having a frontwardly projecting rim for snap-fitting onto the first engagement surface of said case, the rim having a second engagement surface with a polygonal plan profile composed of a plurality of second circular arc surface portions having a common center point and a plurality of second rectilinear surface portions connecting the second circular arc surface portions together, the second circular arc surface portions of said rim being adapted for snap-fitting onto the first circular arc surface portions of the first engagement surface to hold the back cover member and case releasably together.

9. In a timepiece construction, the combination of:

(a) a case having a rearwardly extending flange with a first engagement surface having a polygonal plan profile composed of a plurality of first circular arc surface portions having a common center point and a plurality of first noncircular surface portions connecting the first circular arc portions together, said flange terminating rearwardly in a sealing surface, (b) a back cover member having a back portion with a frontwardly extending rim, the rim having a second engagement surface with polygonal plan profile composed of a plurality of second circular arc surface portions having a common center point and a plurality of second noncircular surface portions connecting the second circular arc portions together, said second circular arc surface portions being adapted for snap-fitting against the first circular arc surface portions to hold the back cover member and case together with the sealing surface being spaced from and facing the back portion of said back cover member, and (c) gasket means interposed between the sealing surface and back portion.

10. The combination of claim 9 wherein the second circular arc surface portions of said second engagement surface are snap-fitted exteriorly around the first circular arc surface portions of said first engagement surface.

11. The combination of claim 9 wherein the gasket means has an outer side with a polygonal plan profile composed of circular arc surface portions with a common center point connected together by rectilinear surface portions.

12. In a timepiece construction, the combination of:

(a) a case having a rearwardly extending flange, said flange having a first engagement surface with a polygonal plan profile composed of a plurality of diametrically opposed first circular arc surface portions connected together by a plurality of opposed first rectilinear surface portions, said flange terminating rearwardly in a sealing surface, (b) a back cover member having a back portion with a frontwardly extending rim, the rim having a second engagement surface with polygonal plan profile composed of a plurality of diametrically opposed second circular arc surface portions connected together by a plurality of opposed second rectilinear surface portions, said second circular arc surface portions being adapted for snap-fitting against the first circular arc surface portions to hold the back cover member and case together with the sealing surface being spaced from and facing the back portion of said back cover member, and (c) gasket means interposed between the sealing surface and back portion.

13. The combination of claim 12 wherein the second circular arc surface portions of said second engagement surface are snap-fitted exteriorly around the first circular arc surface portions of said first engagement surface.

14. The combination of claim 12 wherein the sealing surface of the case flange has a polygonal plan profile composed of a plurality of diametrically opposed circular arc portions connected together by a plurality of opposed rectilinear portions and wherein the gasket means has a generally complementary polygonal plan profile to seat against said sealing surface.

* * * * *